US006283735B1

(12) United States Patent
Schreiber et al.

(10) Patent No.: US 6,283,735 B1
(45) Date of Patent: Sep. 4, 2001

(54) VARIABLE-DELIVERY EXTERNAL GEAR PUMP

(75) Inventors: Bernd Schreiber, Ebersbach-Musbach; Günther Stützle, Bad Schussenried, both of (DE)

(73) Assignee: Schwäbische Hüttenwerke GmbH, Aalen-Wasseralfingen (DE)

( * ) Notice: Subject to any disclaimer, the term of this patent is extended or adjusted under 35 U.S.C. 154(b) by 0 days.

(21) Appl. No.: 09/417,370

(22) Filed: Oct. 13, 1999

(30) Foreign Application Priority Data

Oct. 13, 1998 (DE) ..... 198 47 132

(51) Int. Cl.[7] ..... F04C 2/18; F04C 15/02
(52) U.S. Cl. ..... 418/21
(58) Field of Search ..... 418/21

(56) References Cited

U.S. PATENT DOCUMENTS

| | | | | |
|---|---|---|---|---|
| 1,458,204 | | 6/1923 | Tibbetts . | |
| 2,149,326 | | 3/1939 | Wilkin . | |
| 2,354,992 | | 8/1944 | Gottlieb . | |
| 3,669,577 | * | 6/1972 | Swanson | 418/21 |
| 4,233,005 | | 11/1980 | Bottoms et al. | 418/190 |
| 4,740,142 | | 4/1988 | Rohs et al. | 418/21 |

FOREIGN PATENT DOCUMENTS

| | | |
|---|---|---|
| 698 627 | 11/1940 | (DE) . |
| 29 01 179 | 7/1979 | (DE) . |
| 35 28 651 | 2/1987 | (DE) . |
| 41 21 074 | 1/1993 | (DE) . |
| 781697 | 8/1957 | (GB) . |
| 46-2624 | 1/1971 | (JP) . |
| 57-73880 | 5/1982 | (JP) . |

* cited by examiner

*Primary Examiner*—John J. Vrablik
(74) *Attorney, Agent, or Firm*—Ratner & Prestia

(57) ABSTRACT

A variable-delivery external gear pump comprising a casing, at least one rotatively driven pair of gears comprising two intermeshing spur gears, which form with shell surface areas of the casing and axial sealing surface areas a delivery space comprising a low-pressure side connected to a pump inlet port and a high-pressure side connected to a pump outlet port, and a piston, serving to rotatively mount one spur gear of the pair of gears, said piston being shifted relative to the other spur gear of the pair of gears so as to vary the delivery of the pump together with the one spur gear by charging the high-pressure side with fluid against the force of a return element, wherein formed in at least one axial sealing surface area adjoining a sealing land of the sealing surface area is at least one pocket connecting a zone of deepest tooth engagement of the spur gears to either the pump outlet port or the pump inlet port.

6 Claims, 4 Drawing Sheets

FIG. 2
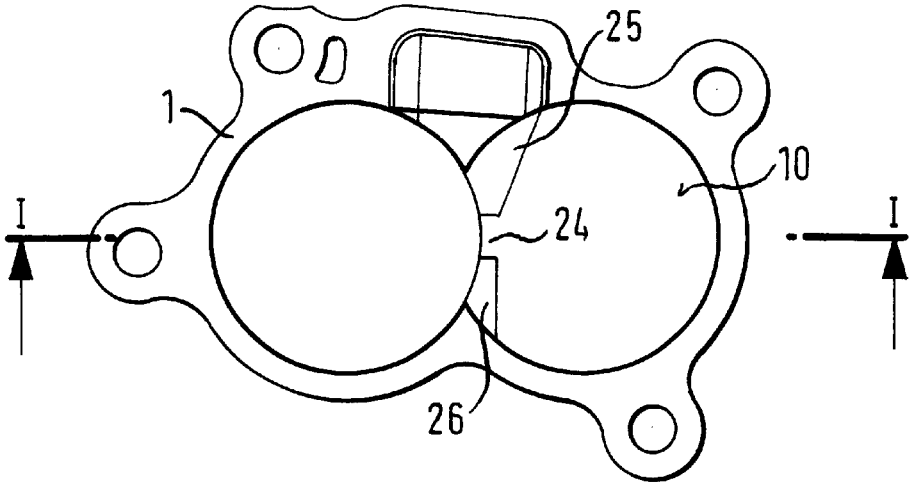
FIG. 3A
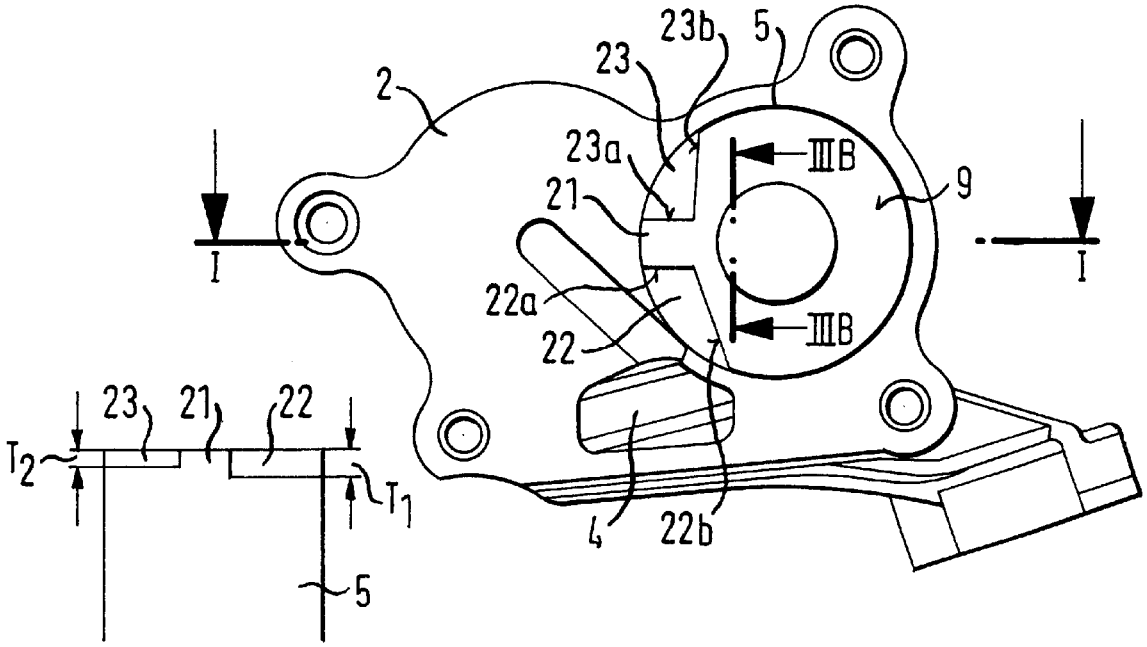
FIG. 3B

VARIABLE-DELIVERY EXTERNAL GEAR PUMP

BACKGROUND OF THE INVENTION

1. Field of the Invention

The invention concerns a variable-delivery external gear pump comprising a casing, at least one rotatively driven pair of gears comprising two intermeshing spur gears which form with shell surface areas of the casing and axial sealing surface areas a delivery space comprising a low-pressure side connected to a pump inlet port and a high-pressure side connected to a pump outlet port, and a piston, serving to rotatively mount one spur gear of said pair of gears, the piston being shifted relative to the other spur gear of said pair of gears so as to vary the delivery of said pump together with the one spur gear by charging said high-pressure side with fluid against the force of a return element. More particularly, the invention concerns an external gear pump which automatically regulates itself with increasing speed.

2. Description of Related Art

One external gear pump in the field concerned is known from German Patent DE 41 21 074 A1.

SUMMARY OF THE INVENTION

It is on the basis of this prior art that an object of the invention is to provide a variable-delivery external gear pump which pumps a fluid to be delivered as consistently and pulsation-free as possible.

This object is achieved in that formed in at least one axial sealing surface area adjoining a sealing land of the sealing surface area is at least one pocket connecting a zone of deepest tooth engagement of the spur gears to either the pump outlet port or the pump inlet port.

The invention is based on an external gear pump comprising, in a casing, a rotatively driven pair of gears with two intermeshing spur gears. The pair of gears is enclosed by casing surface areas which together with axial sealing surface areas contacted by the faces of the spur gears define a delivery space comprising a low-pressure side connected to a pump inlet port and a high-pressure side connected to a pump outlet port. To define the volumetric displacement of the pump, one of the spur gears is rotatively mounted on a piston which, together with this spur gear, is mounted in the casing shiftable relative to the other spur gear. Preferably, the piston is linearly shiftable parallel to the axis of rotation of the spur gear mounted on the piston. By shifting the one spur gear relative to the other spur gear, the intermeshing length of the spur gears is varied for the preferred axial shift.

The intermeshing length is automatically reduced with increasing pumping pressure which increases/decreases depending on the pump speed. Varying the delivery or automatically adjusting the pump to increasing pumping pressure is achieved by charging the piston with fluid at the high-pressure side. The compressive force of the high-pressure fluid is counteracted by the force of a return element. The return element is formed preferably by a compression spring. The compressed fluid forces the piston in the direction of a reduction in the intermeshing length and the return element opposes this compressive force.

Preferably, the pump finds application as a lube pump, more particularly for engine oil delivery in reciprocating piston engines.

In accordance with the invention, a pocket or kidney-shaped recess is formed in at least one axial sealing surface area bordering a sealing land of this sealing surface area and connecting a zone of deepest tooth engagement of the gear teeth with either the pump outlet port or the pump inlet port. The axial sealing surface area directly adjoins a face of one of the spur gears. The sealing land of the sealing surface area covers the bottom of the tooth gap of the deepest tooth engagement of the two gears. The pocket connects the tooth gap in the zone of deepest tooth engagement to the next tooth gap at the high-pressure side or low-pressure side.

Opposite one sealing surface area without pocket, a lesser resistance discharge of the high-pressure fluid from the tooth gap of deepest tooth engagement is assured. The invention thus creates an external gear pump, in which the fluid of the high-pressure side is used to automatically limit the delivery while, however, eliminating or at least reducing the squeezed oil effects involved in such external gear pumps having the known single-plane axial sealing surface areas.

Preferably, the depth of the pocket is, at most, a 5th or, at least, a 20th of the maximum intermeshing length of the two gears, this also applying to any further pocket formed. When further pockets are formed, the depth of each may be the same. If a pocket is formed at both the high-pressure side and the low-pressure side of the sealing surface area, the pocket at the low-pressure side preferably has a depth less than that of the pocket at the high-pressure side. In one preferred embodiment, the otherwise single-plane axial sealing surface area is stepped down to the again single-plane pocket of constant depth. The maximum intermeshing length exists at least at zero delivery and in accordance with the reset characteristic of the return element in the lower speed range of the pump.

The pocket takes up a surface area of minimally 5% and maximally 20% of the surface area covered by the spur gear when in rotation, as measured at the upper edge of the pocket. With increasing pocket surface area, the friction between the sealing surface area and the sweeping face of the spur gear becomes advantageously less.

The pocket is preferably provided at the high-pressure side of the axial sealing surface area, since, in this case, the displacement of fluid in the delivery direction from the squeeze zone of the tightest tooth engagement is facilitated. However, the pocket can also be provided at the low-pressure side, since, in this case, the amount of fluid in the entrapment zone is reduced in any case.

Preferably, a pocket is incorporated into the axial sealing surface area at both the low-pressure side and high-pressure side adjoining the sealing land. Also preferred is that further axial sealing surface areas for the spur gears are each provided with a pocket at the high-pressure side, and even more preferably, each provided with a pocket at the low-pressure side of the respective sealing surface area.

The pump may also comprise several pairs of gears. In particular, a single spur gear, which is then preferably driven, may intermesh with one or several other spur gears and, in this way, form several pair of gears of the pump. Preferably, at least one pocket of the aforementioned kind is also formed in the same way in the zone of deepest tooth engagement of this additional pair of gears or in each additional pair of gears. In one preferred embodiment of the invention, one such additional spur gear is also shiftable relative to the common spur gear for regulating pump delivery by pressurization. In this arrangement, the delivery characteristics of the pair of gears may be the same as each other or differ from each other.

BRIEF DESCRIPTION OF THE DRAWINGS

The invention will now be described in more detail by way of a preferred embodiment with reference to the drawings in which:

FIG. 2 is a plan view of a casing part of the pump, taken along the line 2—2 as shown in FIG. 1 and rotated 180°, FIG. 3A is a plan view of a cover of the pump taken along the line 3A—3A as shown in FIG. 1, FIG. 3B is a plan view of the pockets taken along the line 3B—3B as shown in FIG. 3A.

DETAILED DESCRIPTION

Figure 1:
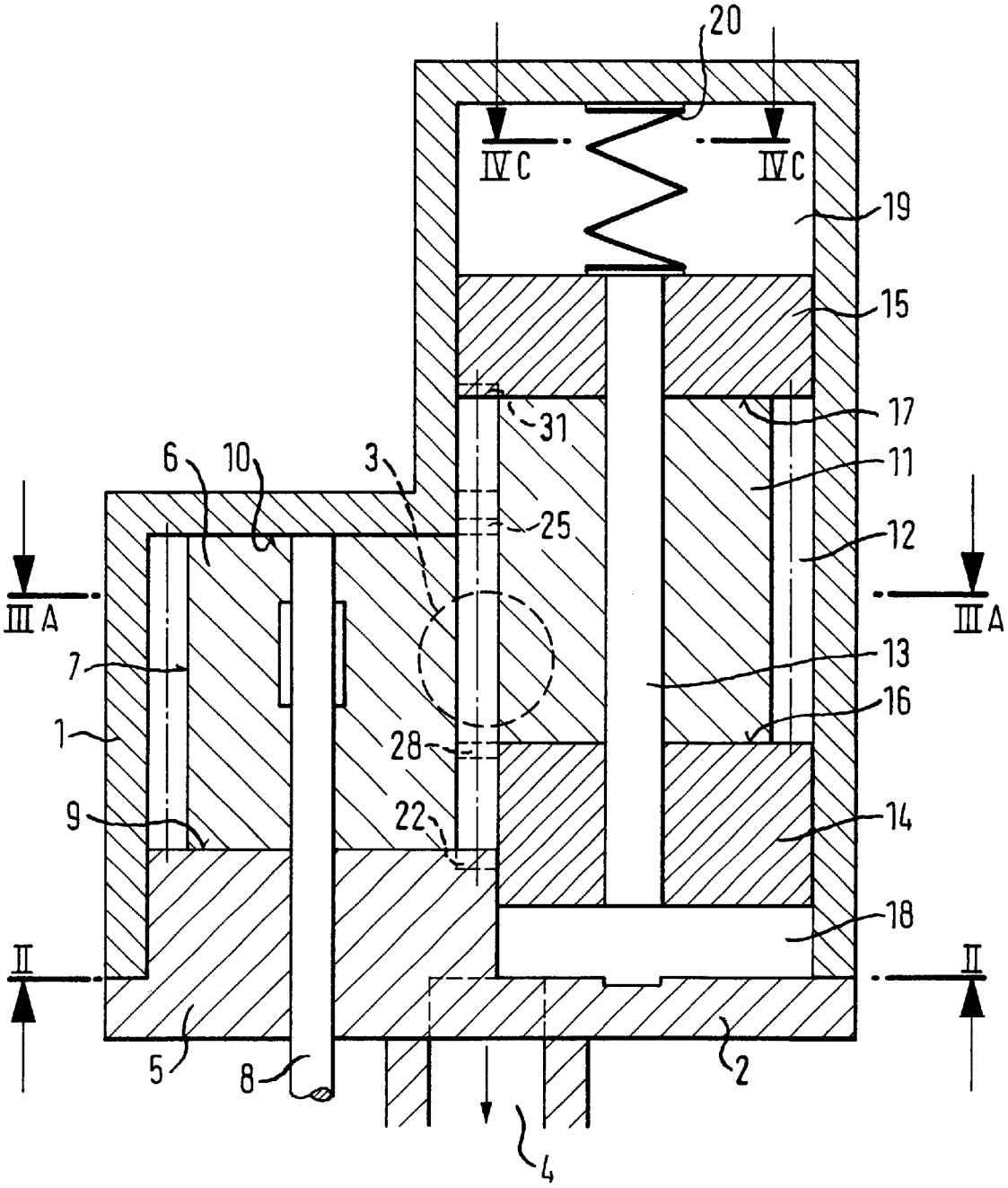
FIG. 1 is a longitudinal section through a variable-delivery external gear pump.

FIG. 1 illustrates a longitudinal section through a variable-displacement external gear pump, whose location is marked as the line 1—1 in the FIGS. 2 and 3.

Figure 5:
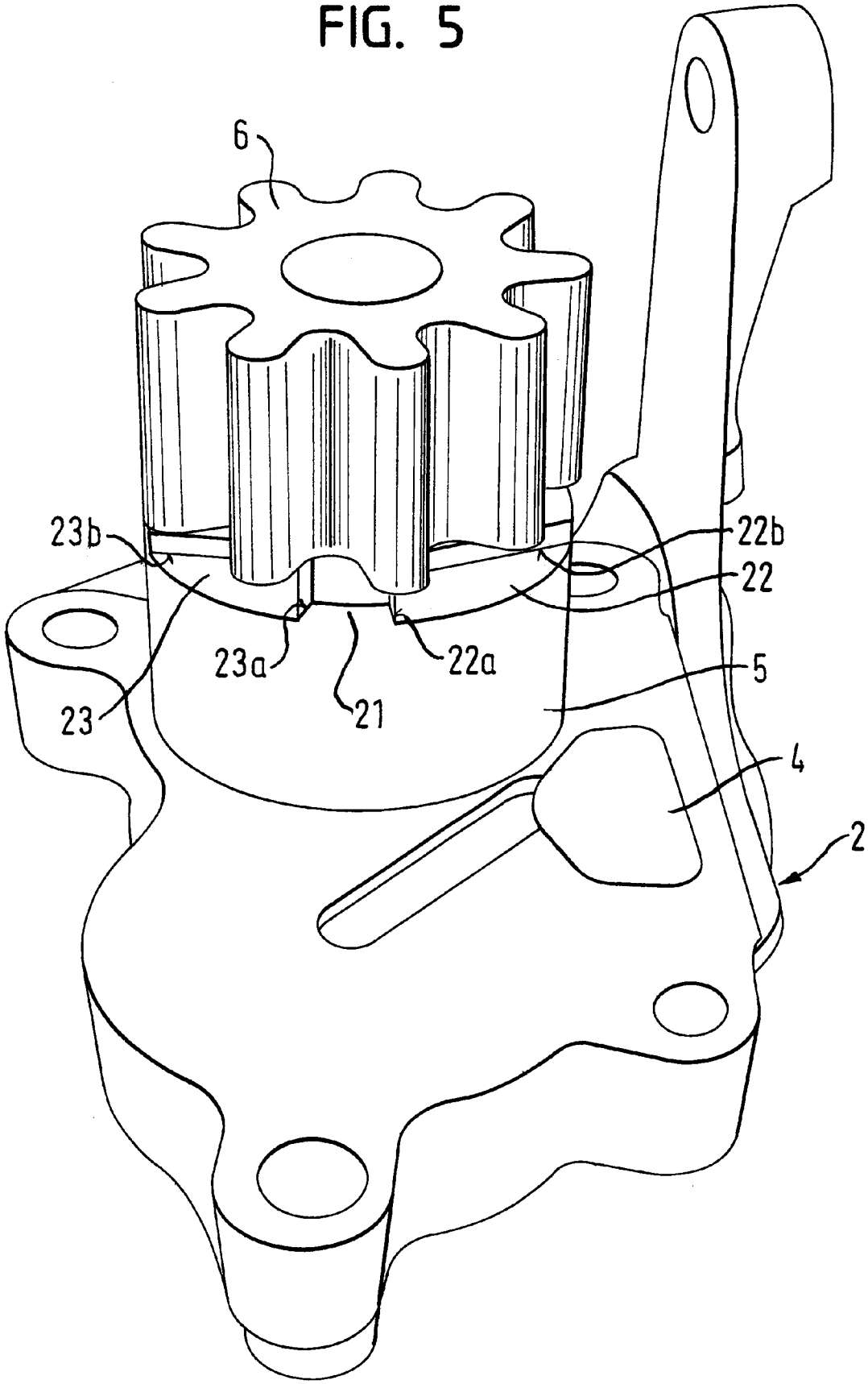
FIG. 5 is a view in perspective of the pump cover, as shown in FIG. 3, including a spur gear.

A casing part 1 and the cover 2, bolted fluid-tight thereto, form a casing of the pump. The casing part 1 and the cover 2 are each individually depicted in FIG. 2 and FIG. 3 respectively, to which, for supplement information, reference is always made; reference also being made to the perspective view of the cover 2 with the mounted spur gear as shown in FIG. 5.

The cover 2 comprises a cover plate and a cylindrical base 5 protruding therefrom. In the casing of the pump, two spur gears 6 and 11 are rotatably mounted around two axis of rotation distanced parallel from each other. The spur gears 6 and 11 intermesh by their toothings 7 and 12. Porting into the meshing zone of the spur gears 6 and 11, on one side of the spur pair of gears, is a fluid inlet port 3 indicated in FIG. 1 by a broken line and a pump outlet port 4 at the side of the spur pair of gears opposite the pump inlet port 3. Rotary drive of the spur gears 6 and 7 delivers fluid from the pump inlet port 3 to the pump outlet port 4.

Rotary drive is provided via a drive shaft 8 rotatably mounted in the base 5 of the cover 2. The spur gear 6 is secured to the drive shaft 8 locked to prevent it twisting and shifting out of place.

The other spur gear 11 is rotatably mounted between two cylindrical bodies 14 and 15 on a journal 13 connecting the two cylindrical bodies 14 and 15 to each other and non-shiftingly relative to the two cylindrical bodies 14 and 15. The two cylindrical bodies 14 and 15 form a piston being linearly shiftable back and forth in a bore of the casing part 1 along the line of the axis of rotation of the spur gear 11. At an outer first face, this piston 14, 15 is charged by the fluid of the high-pressure side. The pump outlet port 4 ports directly into a high-pressure space 18 which is sealed off by the outer first face of the piston 14, 15 or of the cylindrical body 14. At an outer second face of the cylindrical body 15, opposite the outer first face, the piston 14, 15 is urged by an elastic returning force of a steel compression spring 20 extending through return space 19. When the pressure in the high-pressure space 18 increases, the piston 14, 15 is displaced against the returning force of the compression spring 20 relative to the spur gear 6 axially parallel in such a direction that the intermeshing length of the two spur gears 6 and 11 is reduced, it being this reduction in the intermeshing length that diminishes the delivery of the pump. Since the pressure in the high-pressure space 18 increases with increasing pump speed of the spur gears 6 and 11 and this increase leads to a reduction of the intermeshing length of the two spur gears 6 and 7, the pump is automatically down regulated infinitely variable due to pump outlet port 4 and high-pressure space 18 being short circuited. The maximum intermeshing length in the example embodiment corresponds to the length of the two spur gears equal in length, it being attained on zero delivery, more particularly on pump idle, the spur gears 6 and 11 thereby being located level opposite each other.

The fluid delivery from the pump inlet port 3 to the pump outlet port 4 is made through a pumping delivery space sealingly enclosed by the shell surface areas of the casing part 1 about the addendum circles of the spur gears 6 and 11 as well as by the axial sealing surface areas 9, 10, 16 and 17 and ports into that of the pump inlet port 3 and a communicating passage to the pump outlet port 4 on each side of the spur gears 6 and 11. These axial sealing surface areas 9, 10, 16 and 17 are understood in the sense of the invention to be the surface areas of the casing 1, 2 or of the piston 14, 15 which each directly sealingly oppose each of the faces of the spur gears 6 and 11. They seal off the pumping delivery space axially and separate its low-pressure side and high-pressure side from one another, i.e. prevent a short-circuit.

FIGS. 2 and 3 show, in a plan view, the axial sealing surface areas 9 and 10 for the rotatively driven spur gear 6. The axial sealing surface area 9 is formed by the free face of the base 5 of the cover 2. In FIG. 3, the base 5 is also shown in a view of the sealing land 21. The axial sealing surface area 10 is formed opposite the casing part 1. Plan views of the axial sealing surface areas 16 and 17 for the spur gear 11 are evident from FIGS. 4A and 4E.

The axial sealing surface area 9 is a circular ring surface area having an outer diameter corresponding to the diameter of the addendum circle of the spur gear 6. It comprises a single-plane surface, in which on both sides of a sealing land 21, a pocket 22 and 23 is incorporated. In the assembled condition of the pump, the sealing land 21 protrudes into the tooth gap of the deepest tooth engagement of the spur gears 6 and 11 and ensures separation of the low-pressure side from the high-pressure side at the intermesh.

The pockets 22 and 23 are open in the direction of the outer circumferential edge of the axial sealing surface area 9. Each pocket is defined by two control edges 22*a*, 22*b*, 23*a*, and 23*b*, standing at an angle to each other, at which the axial sealing surface area 9 is sloped perpendicular or slightly inclined to the corresponding pocket 22 and 23. The length of the sealing land 21—as measured from the level of the intersection area of the control edges 22*a* and 22*b* of the pocket 22 and the intersection area of the control edges 23*a* and 23*b* of the pocket 23, located at the same level, up to the outer circumferential edge of the sealing surface area 9, which simultaneously forms the outer land edge—corresponds to roughly the tooth height of the spur gears. The depths T1 and T2 of the pockets 22 and 23, or the height of their control edges, amounts to at least a 20th or at most a 5th of the maximum intermeshing length of the spur gears 6 and 11. The bottoms of the pockets 22 and 23 are single-plane from their control edges up to their open edges. The depth T2 of the pocket 23 at the low-pressure side is preferably less than the depth T1 of the pocket 22 at the high-pressure side. In the example embodiment, T1 is an 8th and T2 is a 10th of the maximum intermeshing length of the spur gears 6 and 11.

As measured at the surface area of the circular ring between the addendum circle of the spur gear 6 and the inner diameter of the spur gear 6, the surface area of the pocket 22 at the high-pressure side is minimally 5% and maximally 20% of the surface area of the full, non-interrupted circular ring, the whole surface area between the upper edge of the defining control edges and the outer circumferential edge of the cited circular ring forms the basis of the surface area of the pocket 22. In contrast, the pocket 23 at the low-pressure side is smaller, its surface area %—defined as before—of the whole surface area of the circular ring being between 5 and 15%. The recessed surface area of the pocket 22 is larger in relation to the recessed surface area of the pocket 23 for the same length of the control edge 22*a* defining the sealing land 21, because the second control edge 22*b* oriented at an angle to the sealing land 21 in the case of pocket 22 is oriented at a greater obtuse angle to the control edge 22*a* at the sealing land 21 than the corresponding control edge 23*b* of the pocket 23. The pocket 22 thus, from the outer circumferential edge of the axial sealing surface area 9, covers a longer edge portion than the pocket 23.

The control edges of the pockets 25 and 26 of the opposite sealing surface area 10 are similarly angled as pockets 22 and 23, respectively (FIG. 2). In the assembled condition, the pockets 22 and 25 at the high-pressure side and pockets 23 and 26 at the low-pressure side of the pumping delivery space are located exactly opposite one another. The pairs of pockets are similarly shaped, except that the outer periphery of pockets 25 and 26 and sealing land 24 form a continuous, concave (or recessed) portion to accommodate spur gear 11, in the same manner as sealing surface 16 (discussed below).

Figure 4A:
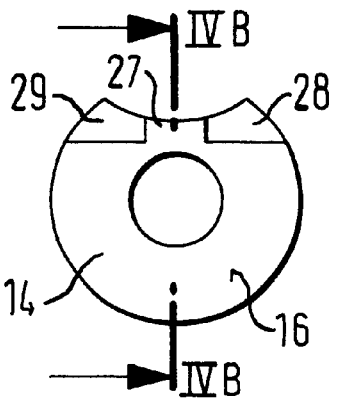
FIG. 4A is a plan view of sealing surface 16 viewed from the direction of line 3A—3A as shown in FIG. 1.
Figure 4B:
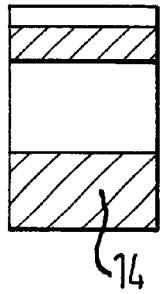
FIG. 4B is a cross-sectional view of cylindrical body 16 viewed from line 4B—4B as shown in FIG. 4A.
Figure 4C:
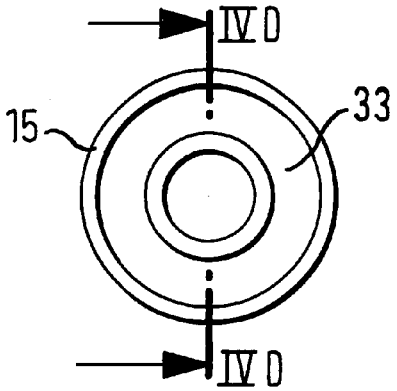
FIG. 4C is a plan view of cylindrical body 15, taken along the line 4C—4C, as shown in FIG. 1.
Figure 4D:
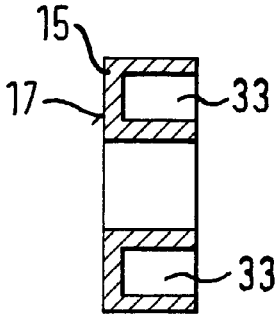
FIG. 4D is a cross-sectional view of cylindrical body 15 viewed from the line 4D—4D, as shown in FIG. 4C.
Figure 4E:
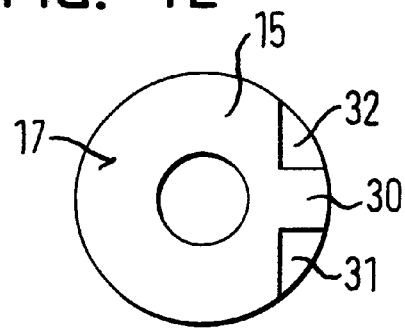
FIG. 4E is a plan view of sealing surface 17 viewed in the direction of line 2—2, as shown in FIG. 1.

In FIGS. 4A, 4B, 4C, and 4E, the cylindrical bodies 14 and 15 are shown individually in plan views of their axial sealing surface areas 16 and 17 and each in longitudinal section. The cylindrical body 15 is additionally depicted in a plan view of its outer face facing the compression spring 20, as shown in FIG. 4C. In FIG. 4E, sealing land 30 and pockets 31 and 32 are depicted.

The cylindrical body 14, sealing off the high-pressure space 18, is single-plane at its face facing the high-pressure space 18 (not shown). Recessed out at the outer shell surface area in the region of its sealing land 27 over the full length of the cylindrical body 14 is a cylindrical segment. In the assembled condition of the pump, this recess is penetrated by the teeth of the spur gears 6 and 11. At the same time, the recess serves as an anti-rotation lock for the piston 14, 15, in that the cylindrical body 14 is able to snugly slide along the base 5. FIG. 4A shows the configuration of the axial sealing surface area 16 with the sealing land 27 adjoined by the pockets 28 and 29.

The same applies to the axial sealing surface area 17 of the cylindrical body 15, as evident from FIGS. 4C–4E. At its outer face facing away from the spur gear 11, the cylindrical body 15 is formed as a cupped ring, including a circumferential annular passage 33 which serves as a guide for the compression spring 20.

What is claimed is:

1. A variable-delivery external gear pump, the pump comprising a) a casing having shell surface areas, a pump inlet port, and a pump outlet port, b) a plurality of axial sealing surface areas, c) at least one rotatively driven pair of gears comprising two intermeshing spur gears which form with said shell surface areas and said plurality of axial sealing surface areas a delivery space comprising a low-pressure side connected to said pump inlet port and a high-pressure side connected to said pump outlet port, d) a return element, and e) a piston, serving to rotatively mount one spur gear of said pair of gears, said piston being shifted axially relative to the other spur gear of said pair of gears so as to vary the delivery of said pump together with the one spur gear by charging said high-pressure side with fluid against the force of said return element, wherein, formed in at least one of said plurality of axial sealing surface areas adjoining a sealing land of said sealing surface area are a first pocket connecting a zone of deepest tooth engagement of said spur gears to said pump outlet port and a second pocket connecting said zone of deepest tooth engagement to said pump inlet port and wherein said first pocket has a first depth and said second pocket has a second depth less than said first depth.

2. The external gear pump as set forth in claim 1, wherein said second pocket is formed in said axial sealing surface area at said low-pressure side of said delivery space and connects said zone of deepest tooth engagement of said gears to said pump inlet port.

3. The external gear pump as set forth in claim 1, wherein a maximum intermeshing length of said spur gears amounts to five to twenty times the depth of said first and second pockets.

4. The external gear pump as set forth in claim 1, wherein, said first pocket, as measured level with said sealing surface area, takes up a surface area amounting to 5% to 20% of a surface area as covered by said spur gear when in rotation, said spur gear adjoining said sealing surface area.

5. The external gear pump as set forth in claim 1, wherein each of said axial sealing surface areas comprises a sealing land with adjoining pockets at said high-pressure side of said delivery space.

6. The external gear pump as set forth in claim 1, wherein each of said axial sealing surface areas comprises a sealing land with adjoining pockets at said low-pressure side of said delivery space.

* * * * *